United States Patent [19]

Levin

[11] Patent Number: 4,924,613

[45] Date of Patent: May 15, 1990

[54] GARMENT WITH REPLACEABLE DISPLAYS

[76] Inventor: Morris A. Levin, 7884D Lexington Club Blvd., Delray Beach, Fla. 33446

[21] Appl. No.: 342,331

[22] Filed: Apr. 24, 1989

[51] Int. Cl.[5] ..... G09F 21/02

[52] U.S. Cl. ..... 40/586; 2/247

[58] Field of Search ..... 40/596; 2/247, 115, 2/118, 119

[56] References Cited

U.S. PATENT DOCUMENTS

| | | | |
|---|---|---|---|
| 1,436,854 | 11/1922 | Brady | 40/586 |
| 2,527,258 | 10/1950 | Kahn | 2/115 |
| 2,589,409 | 3/1952 | Leichter | 2/244 |
| 2,986,743 | 6/1961 | Eilen | 40/586 |
| 3,371,829 | 3/1968 | Phillips | 224/230 |
| 3,438,062 | 4/1969 | Dobell | 2/247 |
| 4,202,053 | 5/1980 | Bell | 2/DIG. 6 |
| 4,389,801 | 6/1983 | Sharrock et al. | 40/586 |
| 4,625,337 | 12/1986 | Zahn | 40/586 |

FOREIGN PATENT DOCUMENTS

| | | | |
|---|---|---|---|
| 2602360 | 2/1988 | France | 40/586 |

*Primary Examiner*—Gene Mancene
*Assistant Examiner*—Michael Lynch
*Attorney, Agent, or Firm*—Alvin S. Blum

[57] ABSTRACT

A garment having a flat panel is provided with a clear, flexible plastic sheet window. One member of a hook-and-loop fastener is affixed to the perimeter of the window. The second member of the hook-and-loop fastener is affixed to the flat panel of the garment in a pattern matching that of the first member on the window. Any sheet or card bearing indicia may be removably displayed on the garment by simply laying it on the garment within the space enclosed by the second member of the fastener and covering it with the window which removably seals it in place when the two members of the hook-and-loop fastener are pressed together. To change indicia, one pulls the window off the garment, replaces the indicia bearing sheet, and presses the window back in place. The invention may be supplied in kit form for application to a garment of the user's choice.

2 Claims, 1 Drawing Sheet

GARMENT WITH REPLACEABLE DISPLAYS

The present invention relates to garments bearing displays and more particularly to a garment having a transparent window through which may be displayed any indicia. Because the transparent window has a perimeter with hook-and-loop fastening means that engages corresponding fastening means on the garment, the indicia is removably held against the garment without any special preparation of the indicia itself.

BACKGROUND OF THE INVENTION

It is common practice to prepare patches bearing indicia of various sorts to be sewn onto a garment. Alternatively, indicia may be sewn or painted directly on the garment.

Rassner in U.S. Pat. No. 2,647,261 and Chrisman in U.S. Pat. No. 2,685,690 teach a detachable insignia panel in which the indicia is permanently applied to a fabric panel which is removably attached to a shirt by snaps. Anderson in U.S. Pat. No. 3,055,133 teaches a transparent garment with pockets inside in which photographs may be inserted for display. Sanchez in U.S. Pat. No. 4,710,981 teaches a flap hingedly applied along one edge to a garment and held to the garment on the other edges by hook-and-loop fastening means. The underside of the opaque flap has indicia fixed thereon for display when the flap is opened. The portion of the garment covered by the flap may also have indicia affixed thereto.

None of the prior art teaches a means of removably displaying on a garment of ordinary fabric a message or image without requiring some special treatment of the indicia such as providing it with fasteners or painting or embroidering it on a panel.

SUMMARY OF THE INVENTION

It is accordingly an object of the invention to provide a means to display a photograph or a sheet of paper, cardboard or the like bearing a message or graphic display on a garment that does not require any change or special treatment or preparation of the material displayed. It is yet another object to provide a garment on which the indicia may be readily changed without any special tools or skills.

The invention comprises a flexible, transparent sheet having a first member of a hook-and-loop fastening means attached to its perimeter. One surface of the garment has the second member of the hook-and-loop fastening means attached thereto in a configuration corresponding to that of the first member on the perimeter. These two members of the fastening means are so arranged that the transparent sheet is sealed against the surface of the garment by simply pressing it in place with the matching fastening means juxtaposed. When the sheet bearing the indicia is to be displayed, it is simply sandwiched in the space between the window and the surface of the garment. The sheet bearing the indicia must fit or be trimmed to fit within the perimeter. The fastening means may be permanently affixed to the transparent window and to the garment by adhesive means or sewing. To change indicia bearing sheets one simply pulls the window open, removes the old sheet, inserts the new sheet and presses the window closed.

One may simply pull off the window to launder the garment without concern for its effect on the window material. Furthermore, a single window may be used with multiple garments having the same perimeter fastening means.

These and other objects, advantages and features of the invention will be understood more fully from consideration of the following detailed description and accompanying drawings.

DETAILED DESCRIPTION OF THE PREFERRED EMBODIMENT

The instant invention may be applied to any garment on which the wearer may wish to display indicia such as a coat, hat or shirt.

Figure 1:
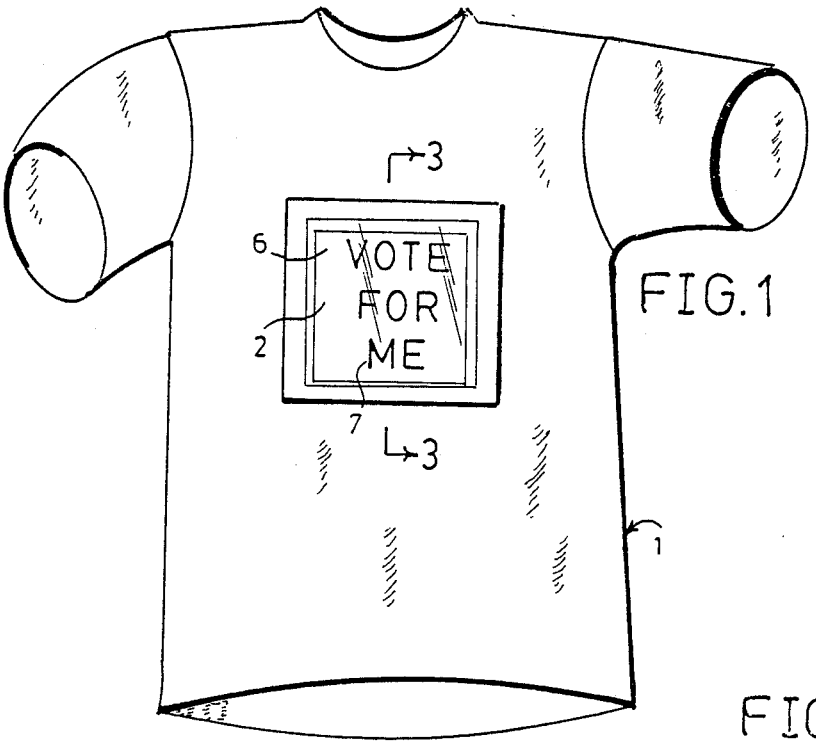
FIG. 1 is a front elevation view of a garment of the invention with a sheet bearing a printed message in place.
Figure 2:
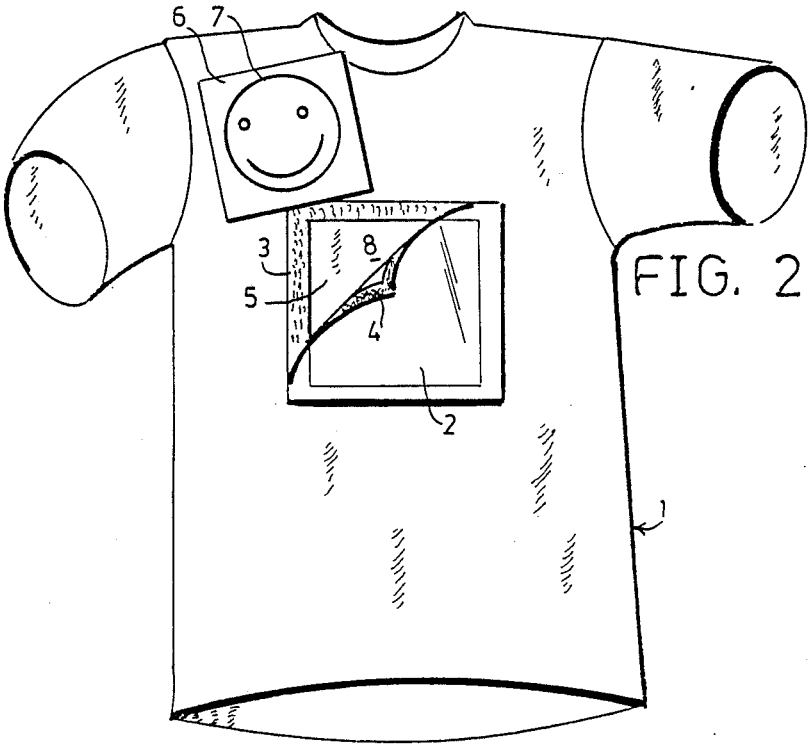
FIG. 2 is a front elevation view of a garment of the invention with the window pulled partially open and a sheet bearing a graphic emblem ready to be inserted.

It is shown in FIGS. 1 and 2 applied to a T-shirt, because it is now fashionable to wear a T-shirt on which has been printed with textile paints indicia including slogans and graphics such as logos of sports teams. In fact, there are shops whose sole product is custom T-shirts on which indicia is permanently applied to suit individual requests. Certain individuals may own a large collection of such shirts to display indicia selected to suit diverse situations.

Figure 3:
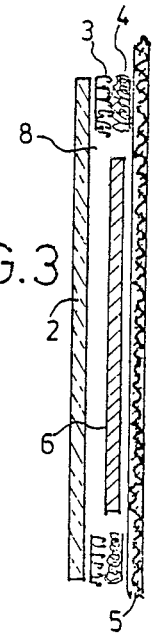
FIG. 3 is a sectional view of FIG. 1 taken on a line through 3—3, on an enlarged scale.

In the invention shown in FIGS. 1 and 2, a transparent, flexible plastic sheet material in the form of a square window 2 has a perimeter to which has been permanently affixed a first portion of a hook-and-loop fastener. In FIGS. 1 and 3 the hook portion 3 is affixed to the entire window perimeter and the loop portion 4 is sewn to the cloth surface 5 of the T-shirt in a configuration exactly matching that of the hook portion 3 on the window 2. They will be in exact registry when a photograph, paper or card 6 bearing indicia 7 is placed on the T-shirt within the boundaries of the fastener and the window is applied thereon and pressed in place to engage the fastening means completely around the perimeter. As seen in the sectional view FIG. 3, the fastening elements, even when closed, have a substantial thickness to provide a space 8 within which the card 6 is completely enclosed and in no danger of accidental loss. In the shirt of FIG. 2, the hook portion 3 is sewn to the T-shirt and the loop portion 4 is affixed to the window 2, shown partially pulled open. The sheet 6 bearing another type of indicia 7 is shown ready to be inserted into the space 8 within the fastener perimeter and between shirt fabric 5 and window 2.

The window 2 may be constructed of a suitable clear plastic film such as plasticized vinyl. The fastening means may be affixed to the window and to the shirt fabric by stitching or cementing.

This invention provides means for displaying photographs and other sheets bearing indicia without alteration or damage thereto. The window may be pulled off to launder the garments without concern for damage to the window. The window may be cleaned with a soft sponge or under running water.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made without the underlying idea or principles of the invention within the scope of the appended claims.

I claim:

1. A garment for displaying interchangeable indicia, comprising:

a garment having at least one substantially flat panel;

a flat window means constructed of flexible and clear plastic sheet material and having a perimeter portion defining its outer edge, said perimeter portion including a top edge; and a first continuous gripping surface means permanently affixed to the entirety of said perimeter portion;

a matching second continuous gripping surface means affixed to said flat panel of said garment in a pattern corresponding to that of said first continuous gripping surface means to provide a space upon said panel and within said pattern for receiving a sheet bearing said indicia, said first gripping surface means is removably engaged by said second gripping surface, in which said first gripping surface means and said second gripping surface means cooperate to seal the entire edge of said flat window means, including said top edge, to said panel and thereby completely seal said indicia therebetween.

2. The garment according to claim 1, in which said gripping surface means are hook-and-loop fastening means.

* * * * *